US006477712B1

(12) United States Patent
Jones

(10) Patent No.: US 6,477,712 B1
(45) Date of Patent: Nov. 12, 2002

(54) TRANSPARENT PROTECTIVE SWIMSUIT COVERING GARMENT

(76) Inventor: Hazel J. Jones, 1969 W. 108th St., Los Angeles, CA (US) 90047

( * ) Notice: Subject to any disclaimer, the term of this patent is extended or adjusted under 35 U.S.C. 154(b) by 0 days.

(21) Appl. No.: 10/056,519

(22) Filed: Jan. 25, 2002

(51) Int. Cl.[7] ..... A41D 13/12
(52) U.S. Cl. ..... 2/69; 2/2.15; 2/456
(58) Field of Search ..... 2/67, 68, 69, 82, 2/455, 456, 457, 2.15, 2.16, 2.17

(56) References Cited

U.S. PATENT DOCUMENTS 2,634,421 A * 4/1953 Ceraulo ..... 2/408
3,744,054 A * 7/1973 Schultz ..... 2/16
4,253,198 A * 3/1981 Estabrook ..... 2/458
4,455,683 A * 6/1984 Moretti ..... 2/457
4,464,795 A * 8/1984 Long et al. ..... 2/2.17
4,546,493 A * 10/1985 Bortnick ..... 139/420 R
5,060,315 A * 10/1991 Ewing ..... 2/109
5,282,277 A * 2/1994 Onozawa ..... 2/108
5,806,090 A * 9/1998 Johnson ..... 2/2.15
5,960,475 A * 10/1999 Fewtrell ..... 2/457
5,996,120 A * 12/1999 Balit ..... 2/243.1
6,032,285 A * 3/2000 Densen ..... 2/456
6,219,841 B1 * 4/2001 Anderson ..... 2/2.17
6,357,048 B2 * 3/2002 Griffiths ..... 2/2.17

* cited by examiner

*Primary Examiner*—Gary L. Welch
(74) *Attorney, Agent, or Firm*—Goldstein & Lavas, P.C.

(57) ABSTRACT

A transparent protective swimsuit covering garment that will be worn by an individual entering a common swimming or bathing area over their swimsuit to prevent exposure to germs existing in water including a body portion adapted for adhering a body of an individual user. The body portion is constructed of a transparent and waterproof material. The body portion has an open neck portion to allow a head of the user to protrude therethrough. The body portion is capable of completely enclosing the body of the individual user. A head cover is adapted for adhering to the head of the individual user. The head cover is constructed of a transparent and waterproof material. The head cover is adapted for coupling with the body portion. The head cover has an open face portion. The head cover completely encloses the head of the individual.

5 Claims, 3 Drawing Sheets

TRANSPARENT PROTECTIVE SWIMSUIT COVERING GARMENT

BACKGROUND OF THE INVENTION

The invention relates to a transparent protective swimsuit covering garment that will be worn by an individual entering a common swimming or bathing area over their swimsuit to prevent exposure to germs existing in water.

Several references show various protective garments. U.S. Pat. No. 2,634,421 to Ceraulo discloses an outer garment to protect a bathing suit from getting wet to allow the user to travel in a dry condition after swimming. U.S. Pat. No. 4,455,683 to Moretti discloses an air tight hooded garment to cover the body of the user. U.S. Pat. No. 5,996,120 to Balit discloses a combination garment capable of being worn as an outer covering or shell for a swimsuit. U.S. Pat. No. 5,060,315 to Ewings discloses a one-piece garment capable of being worn over panty hose or underpants. U.S. Pat. No. 5,282,277 to Onozawa discloses an athletic garment constructed of neoprene to cover the body.

While these units may be suitable for the particular purpose employed, or for general use, they would not be as suitable for the purposes of the present invention as disclosed hereafter.

SUMMARY OF THE INVENTION

It is an object of the invention to produce a transparent protective swimsuit covering garment that will be worn by an individual entering a common swimming or bathing area over their swimsuit to prevent exposure to germs existing in water including a body portion adapted for adhering a body of an individual user. The body portion is constructed of a transparent and waterproof material. The body portion has a zippered opening to allow the body portion to receive the body therein. The body portion has an open neck portion to allow a head of the user to protrude therethrough. The open neck portion has a closable collar. The body portion is capable of completely enclosing the body of the individual user. A head cover is adapted for adhering to the head of the individual user. The head cover is constructed of a transparent and waterproof material. The head cover includes a closable neck portion adapted for coupling with the closable collar of the body portion. The head cover has an open face portion. The head cover completely encloses the head of the individual.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
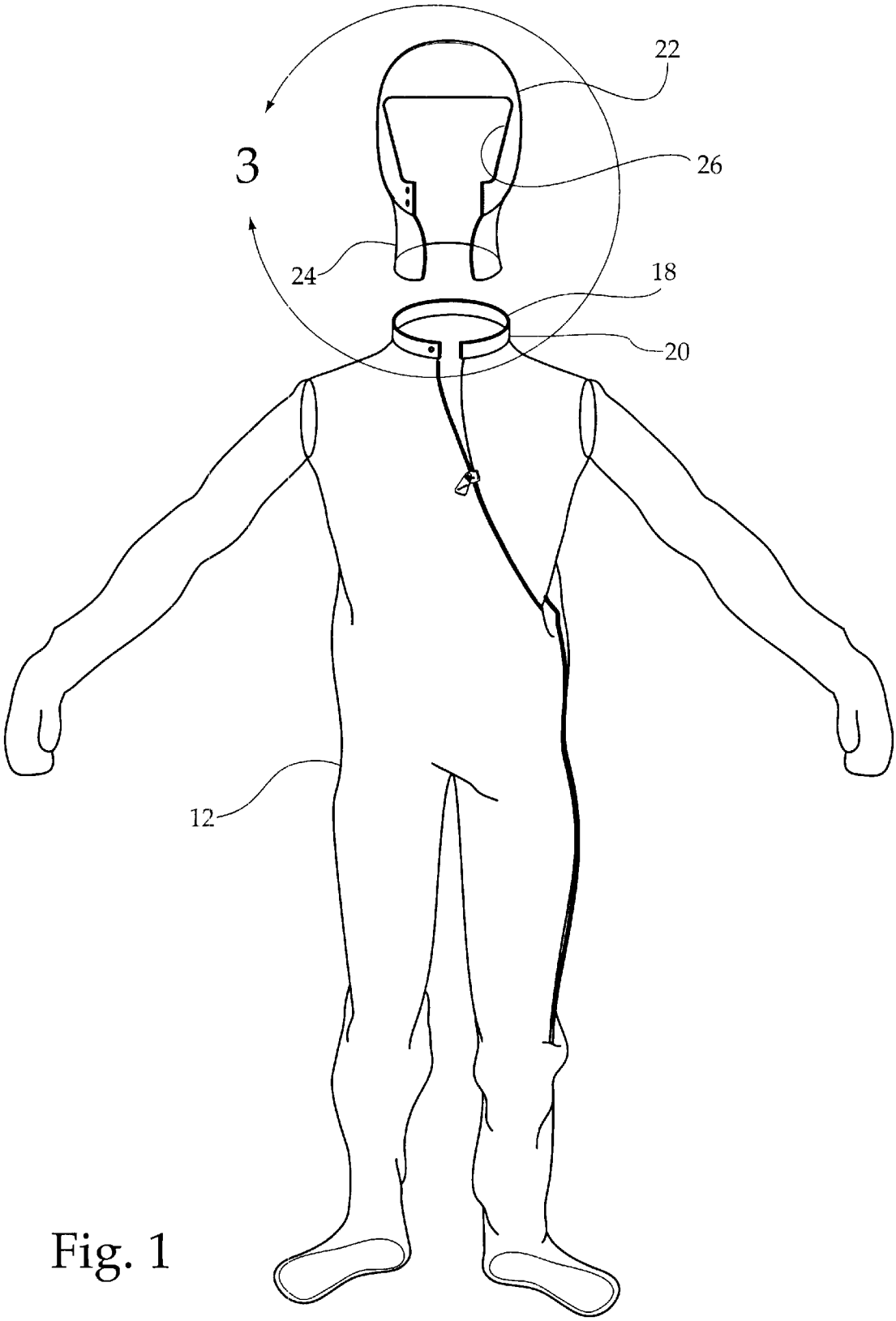
FIG. 1 is a front view of the present invention.
Figure 2:
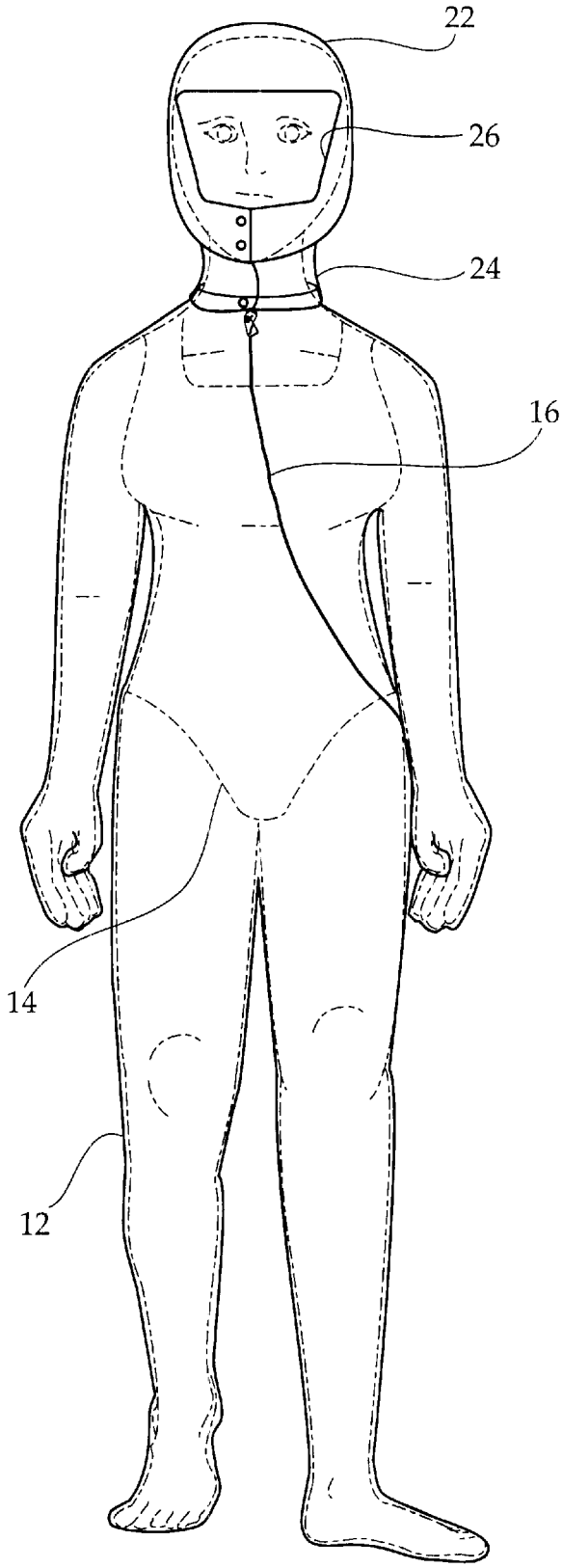
FIG. 2 is a front view of the present invention illustrated in use.
Figure 3:
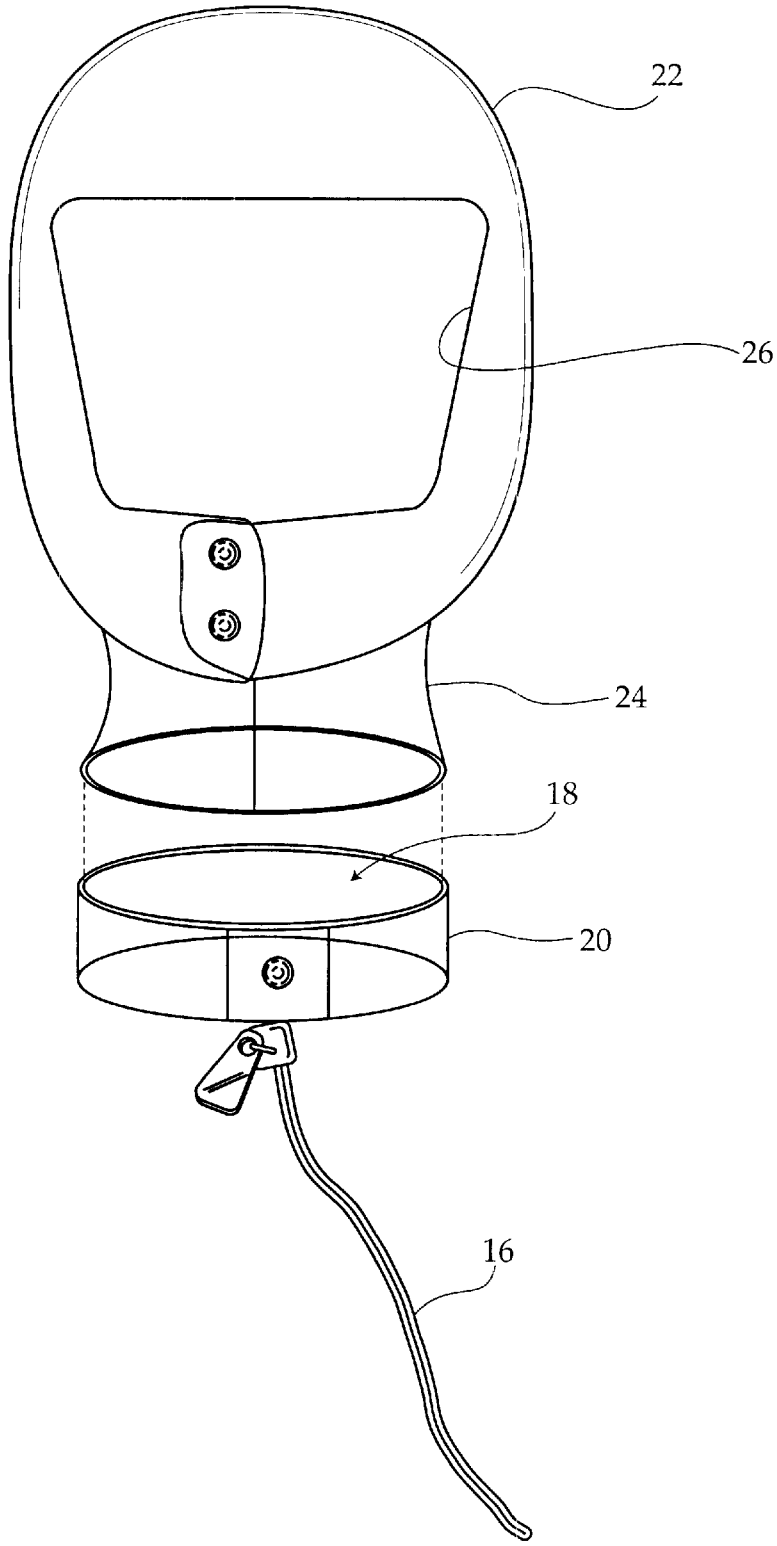
FIG. 3 is a front view of the head cover of the present invention.

It will be noted in the various figures that the device relates to a transparent protective swimsuit covering garment that will be worn by an individual entering a common swimming or bathing area over their swimsuit to prevent exposure of selected areas of the individual's body to germs existing in water. In its broadest context, the device consists of a body portion and a head cover. Such components are individually configured and correlated with respect to each other so as to attain the desired objective.

The body portion 12 is adapted for adhering a body of an individual user. The body portion 12 is constructed of a transparent and waterproof material. When worn, the body portion 12 will prevent water from coming in contact with the body of the wearer. Thus, the body portion 12 will prevent contact with germs present in the water. The transparency of the body portion 12 will allow the swimsuit 14 the user is wearing to be seen through the body portion 12. The body portion 12 has a zippered opening 16 to allow the body portion 12 to receive the body therein. The body portion 12 has an open neck portion 18 to allow a head of the user to protrude therethrough. The open neck portion 18 has a closable collar 20. The body portion 12 is capable of completely enclosing the body of the individual user.

The head cover 22 is adapted for adhering to the head of the individual user. The head cover 22 is constructed of a transparent and waterproof material. The head cover 22 includes a closable neck portion 24 adapted for coupling with the closable collar 20 of the body portion 12. The head cover 22 has an open face portion 26. The head cover 22 completely encloses the head of the individual.

What is claimed is:

1. A transparent protective swimsuit covering garment that will be worn by an individual entering a common swimming or bathing area over their swimsuit to prevent exposure of selected areas of the individual's body to germs existing in water, comprising, in combination:

a body portion, the body portion covering a body, a pair of hands, and a pair of feet of an individual user, the body portion being constructed of a transparent and waterproof material, the body portion having a zippered opening to allow the body portion to receive the body therein, the body portion having an open neck portion to allow a head of the user to protrude therethrough, the open neck portion having a closable collar, the body portion completely enclosing the body of the individual user; and a head cover, the head cover covering the head of the individual user, the head cover being constructed of a transparent and waterproof material, the head cover including a closable neck portion coupled with the closable collar of the body portion, the head cover having an open face portion, the head cover completely enclosing the head of the individual.

2. A transparent protective swimsuit covering garment that will be worn by an individual entering a common swimming or bathing area over their swimsuit to prevent exposure of selected areas of the individual's body to germs existing in water, comprising, in combination:

a body portion, the body portion covering a body, a pair of hands, and a pair of feet of an individual user, the body portion being constructed of a transparent and waterproof material, the body portion having an open neck portion to allow a head of the user to protrude therethrough, the body portion completely enclosing the body of the individual user; and a head cover, the head cover covering the head of the individual user, the head cover being constructed of a transparent and waterproof material, the head cover coupled with the body portion, the head cover having an open face portion, the head cover completely enclosing the head of the individual.

3. The transparent protective swimsuit covering garment as set forth in claim 2, wherein the body portion has a zippered opening to allow the body portion to receive the body therein.

4. The transparent protective swimsuit covering garment as set forth in claim 2, wherein the open neck portion of the body portion has a closable collar.

5. The transparent protective swimsuit covering garment as set forth in claim 4, wherein the head cover includes a closable neck portion coupled with the closable collar of the body portion.

* * * * *